United States Patent [19]

DuBois

[11] 3,948,589

[45] Apr. 6, 1976

[54] PRIMER VALVE

[75] Inventor: Chester G. DuBois, Zion, Ill.

[73] Assignee: Outboard Marine Corporation, Waukegan, Ill.

[22] Filed: Feb. 12, 1975

[21] Appl. No.: 549,200

Related U.S. Application Data

[63] Continuation of Ser. No. 297,179, Oct. 13, 1972, abandoned, which is a continuation-in-part of Ser. No. 85,954, Nov. 2, 1970, Pat. No. 3,746,036.

[52] U.S. Cl. ..... 417/487; 123/187.5 R; 417/479

[51] Int. Cl.[2] ..... F04B 19/00; F02H 1/16

[58] Field of Search ..... 417/394, 479, 480, 487, 417/560; 123/187.5 R, 136

[56] References Cited

UNITED STATES PATENTS

| | | | |
|---|---|---|---|
| 862,867 | 8/1907 | Eggleston | 417/390 |
| 2,092,685 | 9/1937 | Viel | 123/187.5 R |
| 2,707,921 | 5/1955 | Jorgensen | 123/187.5 R |
| 3,048,157 | 8/1962 | Gregory et al. | 123/136 |
| 3,145,659 | 8/1964 | Sevendsen | 417/479 |
| 3,250,224 | 5/1966 | Phillips et al. | 417/479 |
| 3,275,305 | 9/1966 | Nutten | 123/187.5 R |
| 3,451,383 | 6/1969 | Nelson | 123/187.5 R |
| 3,530,842 | 9/1970 | Von Brimer | 123/136 R |

FOREIGN PATENTS OR APPLICATIONS

| | | | |
|---|---|---|---|
| 1,038,576 | 8/1966 | United Kingdom | 417/479 |

*Primary Examiner*—William L. Freeh
*Assistant Examiner*—G. P. LaPointe
*Attorney, Agent, or Firm*—Michael, Best & Friedrich

[57] ABSTRACT

The primer valve disclosed herein includes a housing having an inlet communicating with a fuel source, an outlet communicating with an engine intake manifold, and a flow passageway extending therethrough from the inlet to the outlet. A port surrounded by a valve seat separates the flow passageway into upstream and downstream portions. Flow of the fuel through the flow passageway is controlled by a diaphragm which is movable relative to the valve seat between port opening and port closing positions and is urged toward the port closing position by a spring. Fuel pressure in the upstream portion of the flow passageway acts on the port closing side of the diaphragm and forces the diaphragm toward the port opening position to permit the fuel to be admitted into the engine intake manifold. As a vacuum condition develops in the intake manifold after the engine is started, and consequently in the port, the spring urges the diaphragm to the port closing position to thereby shut off the flow of the fuel to the engine. A pumping means, preferably integral with the housing, is provided for selectively pressurizing the fuel to the level required to force the diaphragm to the port opening position.

11 Claims, 2 Drawing Figures

PRIMER VALVE

CROSS-REFERENCE TO RELATED APPLICATION

This is a continuation of application Ser. No. 297,179 filed Oct. 13, 1972, and now abandoned which is a continuation-in-part of application Ser. No. 85,954 filed on Nov. 2, 1970 now U.S. Pat. No. 3,746,036, which is incorporated herein by reference thereto.

BACKGROUND OF THE INVENTION

This invention relates to valves and, more particularly, to an improved primer valve.

For some types of engines, such as small internal combustion engines, a primer system is used to assist in starting the engine. Such priming systems are arranged to introduce a small quantity of fuel directly into the engine intake manifold valve downstream of the carburetor with the admission of the priming fuel being controlled by a primer valve. Primer valves typically include a spring-loaded check valve in the outlet which is opened when the upstream pressure exceeds the engine intake manifold pressure and overcomes the force of the check valve spring. It is often difficult to build up sufficient pressure to open the check valve, especially when vapors are present in the priming system. Also, this check valve can open inadvertently under high vacuum conditions in the intake manifold during engine operation and allow unwanted fuel to be drawn through the primer valve into the engine intake manifold.

U.S. Pat. No. 3,534,768 discloses a check valve.

SUMMARY OF THE INVENTION

This invention provides a primer valve for controlling the admission of priming fuel to an internal combustion engine, which primer valve is arranged in a manner whereby the vacuum in the engine intake manifold assists in preventing unwanted fuel from being siphoned into the engine after it has been started. In accordance with the invention, the primer valve includes a housing having an inlet communicating with the fuel source, an outlet communicating with the engine cylinder, and a flow passageway extending therethrough from the inlet to the outlet. The flow passageway is separated into upstream and downstream portions by a port which is surrounded by a valve seat.

The flow of fuel through the flow passageway is controlled by a first diaphragm which is movable relative to the valve seat between port opening and port closing positions and is urged to the port closing position by a spring. The port closing side of the first diaphragm is also exposed to the upstream portion of the flow passageway and the backside of the first diaphragm is isolated from the flow passageway and, in one embodiment, is exposed to atmospheric pressure. When the pressure of the fuel in the upstream portion of the flow passageway exceeds a predetermined level, the first diaphragm is forced to the port opening position and the fuel is admitted into the engine. The vacuum or sub-atmospheric pressure produced by the cylinder during engine operation is reflected in the downstream portion of the flow passageway and the spring urges the first diaphragm to the port closing position to shut off the flow of fuel to the engine and thereby prevents unwanted fuel from being drawn through the primer valve into the engine.

In accordance with another embodiment of the invention, the backside of the first diaphragm is connected in communication with the fuel source so that, when a sub-atmospheric pressure condition does not exist in the downstream portion of the flow passageway, the opposing pressures acting on the first diaphragm are substantially equal and the first diaphragm is urged by the spring to the port closing position even though the fuel source is pressurized.

Also in accordance with this invention, a pumping means is provided in the housing for selectively pressurizing the fuel in the upstream portion of the fuel passageway to the predetermined level necessary to force the first diaphragm to the port opening position. In a preferred embodiment, the pumping means includes a second diaphragm mounted in the housing and having one side cooperating with the housing to define a fuel chamber into which the fuel is admitted from the fuel source. The second diaphragm is movable from a first position to a second position to reduce the volume of the fuel chamber and to thereby increase the pressure of the fuel in the upstream portion of the flow passageway. An actuation means is provided for effecting such movement of the second diaphragm.

Since the fuel acting on the first diaphragm to force it to the opening position is pressurized by the pumping means, the presence of vapors in the priming system does not substantially affect the operation of the primer valve. The higher negative pressure differential created across the port closing portion of the first diaphragm, as a higher vacuum is produced by the engine cyclinder, causes the first diaphragm to seal more tightly against the valve seat and thereby further insures agains unwanted flow of the fuel into the engine, even under high vacuum conditions.

A primary object of this invention is to provide a simple primer valve which is capable of reliably controlling the flow of fuel even though vapors are present in the priming system.

Another object of this invention is to provide a primer valve capable of preventing flow of unwanted fuel even though high vacuum conditions exist in the engine downstream of the valve.

Another object of this invention is to provide a priming device having a valve and an integral pumping means.

Another object of this invention is to provide a primer valve communicating with a source of fuel and the cylinder of an internal combustion engine.

Another object of this invention is to provide a primer valve communicating with a pressurized fuel source and the cylinder of an internal combustion engine which primer valve is arranged to prevent unwanted fuel from being admitted to the cylinder when sub-atmospheric conditions do not exist therein.

Another object of this invention is to provide a priming system for an internal combustion engine which is normally sealed to the atmosphere.

Other objects and advantages of this invention will become apparent from the following description and accompanying drawings.

DESCRIPTION OF THE PREFERRED EMBODIMENTS

Figures 1, 2:
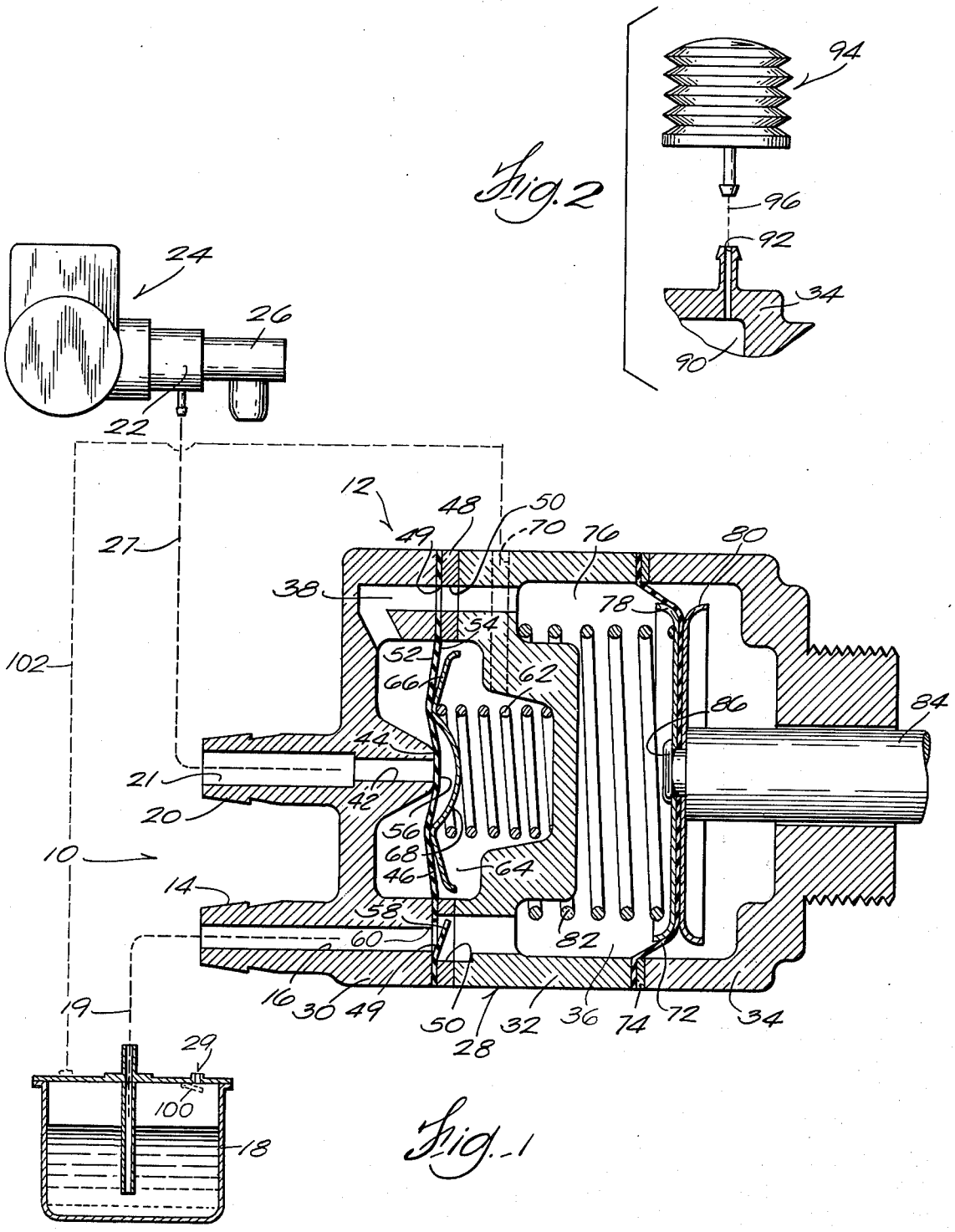
FIG. 1 is a partially diagrammatic view of a priming system for an internal combustion engine employing a primer valve constructed according to this invention and with the primer valve shown in enlarged cross section.
FIG. 2 is a fragmentary, sectional view of an alternate arrangement for the actuation means.

Before explaining the invention in detail, it is to be understood that the invention is not limited in its application to the details of construction and arrangement of the components set forth in the following description or illustrated in the drawing. The invention is capable of other embodiments and of being practiced or carried out in various ways. Also, it is to be understood that the phraseology or terminology employed herein is for the purposes of description and should not be regarded as limiting.

Referring to FIG. 1, the priming system 10 includes a primer valve 12 which is constructed in accordance with the invention. The primer valve 12 includes an inlet 14 which is provided by an inlet passage 16 and which is connected to a fuel tank 18 by a flexible hose illustrated by dashed line 19 and an outlet 20 which is provided by an outlet passage 21 and which is connected to the intake manifold 22 and in communication with the cylinder (not shown) of an internal combustion engine 24 downstream of the carburetor 26 by a flexible hose illustrated by dashed line 27. In the construction illustrated in FIG. 1, the fuel tank 18 is vented to atmosphere through a vent 29 provided in the top portion of the fuel tank. To assist in starting the engine 24, the primer valve 12 is actuated to admit a small quantity of fuel directly into the engine intake manifold 22.

The primer valve 12 includes a housing 28 which is formed from housing members 30, 32 and 34 and has a flow passageway 36 extending therethrough from the inlet passage 16 to the outlet passage 21. The flow passageway 36 is separated into an upstream portion 38 and a downstream portion, i.e. the outlet passage 21, by a port 42 surrounded by a valve seat 44.

A first relatively thin, flexible diaphragm 46, is mounted between the housing members 30 and 32 and is maintained in sealing engagement therewith by a gasket 48. The diaphragm 46 and the gasket 48 are provided with apertures 49 and 50, respectively, which form a part of the upstream portion 38 of the flow passageway 36. The diaphragm 46 has a port side 52 which is exposed to the upstream portion 38 of the flow passageway 36 and the port 42 and a backside 54 which is isolated from the flow passageway 36 and exposed to atmospheric pressure. The diaphragm 46 is movable between a first position to close the port 42 and a second position to open the port 42 and includes a valve portion 56 which seats against the valve seat 44 to close the port 42. The diaphragm 46 can be fabricated from a suitable material which is impervious to fuels, such as a fabric composition, plastic, rubber or elastic synthetic materials.

The diaphragm 46 also includes an integral flapper valve section 58 which operates in response to the pressure differential between the upstream and downstream sides thereof to open and close a port 60 provided by the inlet passage 16 to control the admission of the fuel from the fuel tank 18 into the upstream portion 38 of the flow passageway 36.

In order to urge the valve portion 56 of the diaphragm 46 into sealing engagement with the valve seat 44 to close the port 42, there is provided a spring 62 which is located in a spring chamber 64 provided in housing member 32. The spring 62 bears against a movable support 66 engaging the backside 54 of the diaphragm 46. The movable support 66 preferably includes a cupped or depressed central section 68 axially aligned with the port 42 and is movable along with the diaphragm 46 during opening and closing of the port 42. Since the central portion of the diaphragm 46 is unsupported by the cup section 68 of the movable support 66, the valve portion 56 of the diaphragm 46 is permitted to conform to the periphery of the valve seat 44 and forms a uniform seal with the valve seat 44 even though the spring 62 may not be squarely bearing against the movable support 66. In other words, uniform sealing is provided even though the spring 62 may be slightly cocked with respect to the valve seat 44.

The spring 62 is arranged so that at a predetermined positive pressure differential between the port side 52 and the backside 54 of the diaphragm 46, the biasing force of the spring 62 is overcome and the diaphragm 46 moves away from the valve seat 44. The port 42 is thereby opened to permit a small quantity of the fuel to flow from the upstream side 38 of the flow passageway 36 through the outlet 20 and into the engine intake manifold 22. In order to maintain a substantially constant pressure on the backside 54 of diaphragm 46 and facilitate the movement of the diaphragm 46 away from the valve seat 44, the spring chamber 64 is vented to atmosphere via a vent port 70 provided in the housing member 32.

After the engine is started, the vacuum or subatmospheric condition developed in the engine intake manifold 22 is reflected in the outlet passage 21 and the diaphragm 46 is urged back to the port closing position to close port 42 by the combined effect of the spring 62 and the atmospheric pressure in the spring chamber 64 acting on the backside 54 of the diaphragm 46. Unwanted fuel is accordingly prevented from being siphoned into the engine from the fuel tank 18 during engine operation. Since the backside 54 of the diaphragm 46 is exposed to atmospheric pressure, any increase in the vacuum created in the engine intake manifold 22 results in an increased pressure differential across the diaphragm 46 thereby producing a tighter seal between the valve portion 56 and the valve seat 44 to further insure against fuel being siphoned into the engine, even during high vacuum conditions.

In order to provide sufficient fuel pressure to move the diaphragm 46 to the port opening position, the primer valve 12 is provided with an integral pumping means which pressurizes the fuel in the upstream portion 38 of the flow passageway 36. Various pumping means capable of performing this function can be provided.

In the construction illustrated in FIG. 1, the pumping means includes a second diaphragm 72 which is mounted between the housing members 32 and 34, is maintained in sealing engagement with the housing members 32 and 34 by a gasket 74, and defines a fuel chamber 76 forming a part of the upstream portion 38 of the upstream flow passage 36. The fuel is admitted into the fuel chamber 76 through the flapper valve section 58. The diaphragm 72 is movable between a first or pumping position and a second or priming position to reduce the volume of the fuel chamber 76 and thereby increase the pressure of the fuel in the fuel chamber 76. The second diaphragm 72 can be fabricated from the same type of fuel impervious materials as the first diaphragm 46.

At least the central portion of the diaphragm 72 is supported on its opposite sides by support members 78 and 80. In order to urge the diaphragm 72 towards the pumping position there is provided a spring 82 which is located inside the fuel chamber 76 and bears against support member 78.

It should be understood that other suitable means, such as a reciprocative piston in sealing engagement with the inside walls of the housing 28, can be provided to produce the desired pumping action.

Various actuation means can be provided for moving the diaphragm 72 against the biasing force of the spring 82 from the pumping position to the priming position. In the construction illustrated in FIG. 1, such actuation means is mechanical and includes a push rod 84 which slidably extends outwardly through the outer end of the housing member 34 and is suitably attached at one end of the diaphragm 72 such as by a bolt 86 which extends through apertures provided in support members 78, 80 and the diaphragm 72 and which is threaded into the inner end of the push rod 84. The diaphragm 72 is moved from the pumping position to the priming position (i.e. moved to the left as viewed in FIG. 1) by depressing the outer end of rod 84 to increase the pressure of the fuel in the fuel chamber 76. The resultant increased fuel pressure closes the flapper valve section 58 and acts on the port side 52 of the diaphragm 46 to overcome the biasing force of the spring 62, thereby moving the diaphragm 46 away from the valve seat 44 to permit the fuel to flow from the fuel chamber 76 through the outlet passage 21 and into the engine intake manifold 22.

When the push rod 84 is released, the biasing force of the spring 82 urges the diaphragm 72 back to the pumping position. The reduced pressure in the fuel chamber 76 produced by the resultant increased volume of the chamber permits the flapper valve section 58 to open the port 60 and the fuel is admitted from the fuel tank 18 into the fuel chamber 76 through the inlet passage 16 for the next priming operation.

Another form of actuation means is illustrated in FIG. 2 which is pneumatic and includes a pressurization chamber 90 defined by the diaphragm 72 (which is arranged in the same manner as shown in FIG. 1) and the housing member 34, a pressurization port 92 communicating with the pressure chamber 90, and a suitable source of pressurization such as a squeeze bulb 94 which is connected to the pressurization port 92 by a flexible hose illustrated by dashed lines 96.

When the pressure chamber 90 is pressurized, such as by depressing the squeeze bulb 94, the pressure differential across the diaphragm 72 causes it to be moved to the priming position and the engine is primed as described above. When the pressure in the pressure chamber 90 is reduced, such as by releasing the squeeze bulb 94, the diaphragm 72 is returned to the pumping position by the biasing force of the spring 82 and the flapper valve section 58 opens to admit fuel from the fuel tank 18 into the fuel chamber 76 for the next priming operation as described above.

Under some circumstances (other than during the pumping operation or when vacuum conditions do not exist in the engine intake manifold 22), the pressure acting on the port side 52 of the diaphragm 46 can exceed the atmospheric pressure acting on the backside 54 and cause the diaphragm valve portion 56 to be moved away from the valve seat 44 to open the port 42 and thereby allow unwanted fuel to escape into the engine intake manifold 22. For example, if the fuel tank 18 is pressurized, the pressurized fuel passing through the upstream portion 38 of the flow passageway 36 acts on the port side 52 of the diaphragm 56 and forces the diaphragm to a port opening position and thereby permits unwanted fuel to escape through the port 42 into the engine intake manifold 22. In accordance with an alternate embodiment of this invention, the backside 54 of the diaphragm 46 is connected in communication with the fuel tank 18 so that substantially equal pressures act on both sides of the diaphragm 46.

While other constructions can be employed, in the construction illustrated by dashed lines in FIG. 1, the fuel tank 18 is maintained under pressure and the fuel tank vent 29 includes a vent valve 100 (illustrated in dashed lines) which operates in response to the pressure differential between the internal fuel tank pressure and the atmospheric pressure to close and open the vent 29 and to thereby respectively prevent fuel vapors from escaping from the fuel tank and to admit air into the fuel tank.

In order to prevent the pressurized fuel in the upstream portion 38 of the flow passageway 36 from forcing the diaphragm 46 to a port opening position, when a vacuum condition does not exist in the engine intake manifold 22, the spring chamber 64 is connected in communication with the fuel tank 18 by a flexible hose (illustrated by dashed line 102) which extends between the spring chamber vent port 70 and a port in the fuel tank 18. With the arrangement, the priming system 10 is a sealed system. Also, the pressures acting on the port side 52 and the backside 54 of the first diaphragm 46 are substantially equal, when the second diaphragm 72 is in a priming position and a vacuum condition does not exist in the engine intake manifold 22, and the spring 62 urges the valve portion 56 into sealing engagement with the valve seat 44 to prevent unwanted fuel from escaping to the engine intake manifold.

Various features of the invention are set forth in the following claims.

I claim:

1. A primer for supplying fuel to an internal combustion engine, said primer comprising a housing including a partition dividing said housing into first and second chambers, an inlet in said housing communicating with said first chamber and adapted to communicate with a fuel source, an outlet communicating with said second chamber and adapted to communicate with the engine, a flow passageway extending in said housing from said first chamber, through said second chamber to said outlet and including a port communicating with said second chamber, surrounded by a valve seat, and separating said flow passageway into an upstream portion communicating with said first chamber and a downstream portion communicating with said outlet, a first diaphragm mounted by said housing in said second chamber and including a first side cooperating with said housing to partially define said flow passageway and located in operative relation to said port, said first diaphragm being movable relative to said port in response to opposing forces acting thereon between a port closing position and a port opening position, said first diaphragm also including a second side, a first spring means acting between said partition and said second side of the said first diaphragm and urging said first diaphragm toward said port closing position to shut off fuel flow to the engine, a second diaphragm mounted by said housing in said first chamber and having a first side cooperating with said housing to define a fuel pumping sub-chamber communicating with said upstream portion of said flow passageway, said second diaphragm being movable relative to a position adjacently spaced from said partition and in which the volume of said fuel pumping sub-chamber is reduced, a second spring means acting between said partition and said first side of said second diaphragm for biasing said second diaphragm away from said position, check valve means associated with said inlet and operable to admit fuel through said inlet into said fuel pumping sub-chamber and to prevent escape of fuel through said inlet from said fuel pumping sub-chamber, and actuating means for selectively moving said second diaphragm to said position against the action of said second spring means to close said check valve means and to increase the pressure of the fuel in said upstream portion of said flow passageway to thereby move said first diaphragm against the action of said first spring means to said port opening position.

2. A primer in accordance with claim 1 wherein said housing includes a first member partially defining said second chamber and including said outlet and said port, a second member including said partition, and a third member partially defining said first chamber, said first, second, and third members being assembled together in series with said first diaphragm being supported between said first and second members and with said second diaphragm being supported between said second and third members.

3. A primer in accordance with claim 1 wherein each of said first, second and third members is generally circular in shape and wherein said first, second, and third members are generally co-axially arranged.

4. A primer in accordance with claim 1 wherein said first and second spring means are generally co-axially arranged helical springs.

5. A primer valve according to claim 1 wherein said check valve means comprises a flapper valve section integral with said first diaphragm.

6. A primer valve according to claim 1 including means for exposing said second side of said first diaphragm to atmospheric pressure.

7. A primer valve according to claim 1 including means for connecting said second side of said first diaphragm in communication with said source of fuel.

8. A primer valve in accordance with claim 1 and in further combination with a fuel tank adapted to be pressurized and including one-way valve means permitting entry of air into said tank and preventing escape of fuel from said tank, and means communicating said second side of said first diaphragm with said fuel tank.

9. A primer valve according to claim 1 wherein said actuating means includes a push rod which is operatively connected at one end to said second diaphragm and slidably extends outwardly through said housing, said push rod being movable against the biasing force of said second spring means to move said second diaphragm to said position adjacently spaced from said diaphragm.

10. A primer valve according to claim 1 wherein said second diaphragm includes a second side and wherein said actuating means includes a pressure sub-chamber defined by said second side of said second diaphragm and said housing, a pressurization port in said housing communicating with said pressure sub-chamber; and pressurization means connected to said pressurization port for selectively pressurizing said pressure sub-chamber to thereby move said second diaphragm to said position adjacently spaced from said partition.

11. A primer valve according to claim 10 wherein said pressurization means is a squeeze bulb.

* * * * *